US006662606B2

(12) United States Patent
Rodriguez

(10) Patent No.: US 6,662,606 B2
(45) Date of Patent: Dec. 16, 2003

(54) LOCK CYLINDER RETAINER

(75) Inventor: Lawrence G. Rodriguez, Anaheim, CA (US)

(73) Assignee: Newfrey LLC, Newark, DE (US)

( * ) Notice: Subject to any disclaimer, the term of this patent is extended or adjusted under 35 U.S.C. 154(b) by 198 days.

(21) Appl. No.: 09/885,588

(22) Filed: Jun. 20, 2001

(65) Prior Publication Data

US 2002/0194889 A1 Dec. 26, 2002

(51) Int. Cl.[7] ..... E05B 13/10

(52) U.S. Cl. ..... 70/224; 70/216; 70/370; 70/372; 70/DIG. 39; 292/336.3; 292/347

(58) Field of Search ..... 70/224, 370, 372–374, 70/DIG. 31, DIG. 39, 451, 215–217, 221–223, 466; 292/347, 336.3

(56) References Cited

U.S. PATENT DOCUMENTS

| | | | | | |
|---|---|---|---|---|---|
| 897,685 | A | * | 9/1908 | Voight | 70/374 |
| 1,338,053 | A | | 4/1920 | Voight | |
| 1,389,805 | A | * | 9/1921 | Wycherley | 70/370 |
| 1,407,472 | A | * | 2/1922 | Maxwell | 70/370 |
| 1,501,315 | A | * | 7/1924 | Dement | 70/370 |
| 1,579,139 | A | * | 3/1926 | Phillips | 70/372 |
| 1,854,563 | A | * | 4/1932 | Shaw | |
| 1,877,404 | A | | 9/1932 | Jacobi | |
| 2,207,878 | A | * | 7/1940 | Schlage | 70/370 |
| 2,677,953 | A | | 5/1954 | Fisler et al. | 70/224 |
| 3,046,777 | A | | 7/1962 | Schlage | 70/371 |
| 3,190,091 | A | | 6/1965 | Russell et al. | 70/224 |
| 3,190,092 | A | * | 6/1965 | Patriquin | 70/373 |
| 3,190,684 | A | | 6/1965 | Russell | 292/347 |
| 3,286,773 | A | * | 11/1966 | Russell et al. | 70/372 |
| 3,308,641 | A | | 3/1967 | Russell et al. | 70/224 |
| 3,343,386 | A | | 9/1967 | Hall | 70/423 |
| 3,413,829 | A | | 12/1968 | Russell | 70/224 |
| 3,851,508 | A | * | 12/1974 | McCurdy | 70/370 |
| 3,928,991 | A | * | 12/1975 | Gaul et al. | 70/493 |
| 4,073,172 | A | * | 2/1978 | Schlage | 70/370 X |
| 4,143,897 | A | | 3/1979 | Bergen | 292/347 |
| 4,231,243 | A | * | 11/1980 | Thirion | 70/373 X |
| 4,995,249 | A | | 2/1991 | Preissler et al. | 70/224 |
| 5,233,851 | A | * | 8/1993 | Florian | 70/370 X |
| 5,398,531 | A | | 3/1995 | Shen | 70/224 |
| 5,481,890 | A | | 1/1996 | Millman | 70/224 |
| 5,752,399 | A | | 5/1998 | Shen | 70/224 |
| 5,884,512 | A | * | 3/1999 | Wayne | 70/370 |
| 6,014,877 | A | | 1/2000 | Shen | 70/371 |
| 6,079,240 | A | | 6/2000 | Shvarts | 70/367 |
| 6,412,319 | B1 | * | 7/2002 | Adelmeyer et al. | 70/224 |
| 2002/0189305 | A1 | * | 12/2002 | Shen | 70/224 |

FOREIGN PATENT DOCUMENTS

| | | | | |
|---|---|---|---|---|
| DE | 281443 | * | 6/1915 | 70/370 |
| DE | 401036 | * | 8/1924 | 70/370 |
| GB | 692594 | * | 6/1953 | 70/370 |

* cited by examiner

*Primary Examiner*—Lloyd A. Gall
(74) *Attorney, Agent, or Firm*—Richard J. Veltman; John D. Del Ponti

(57) ABSTRACT

A lock cylinder retainer comprises an annular portion and a rectangular portion extending from the annular portion. The annular portion is configured to engage a lock cylinder core and the rectangular portion is configured to engage a pin housing associated with the cylinder core. The annular portion includes a front edge and a flange extending radially inwardly from the front edge and the rectangular portion includes a front surface, a pair of parallel side surfaces and a top surface. The front, top and side surfaces cooperate to partially enclose the pin housing.

3 Claims, 2 Drawing Sheets

LOCK CYLINDER RETAINER

BACKGROUND OF THE INVENTION

In the case of some exterior door knob constructions, the lock cylinder does not exactly mate with the exterior knob due to slight variations in manufacturing tolerances. As a result, there is a small amount of movement between the lock cylinder and the knob that is undesirable. A lock cylinder retainer that eliminates the undesirable movement would be welcome by manufactures and consumers.

SUMMARY OF THE INVENTION

A lock cylinder retainer comprises an annular portion and a rectangular portion extending from the annular portion. The annular portion is configured to engage a lock cylinder core and the rectangular portion is configured to engage a pin housing associated with the cylinder core. The annular portion includes a front edge and a flange extending radially inwardly from the front edge and the rectangular portion includes a front surface, a pair of parallel side surfaces and a top surface. The front, top and side surfaces cooperate to partially enclose the pin housing.

DETAILED DESCRIPTION OF THE DRAWINGS

Figure 1:
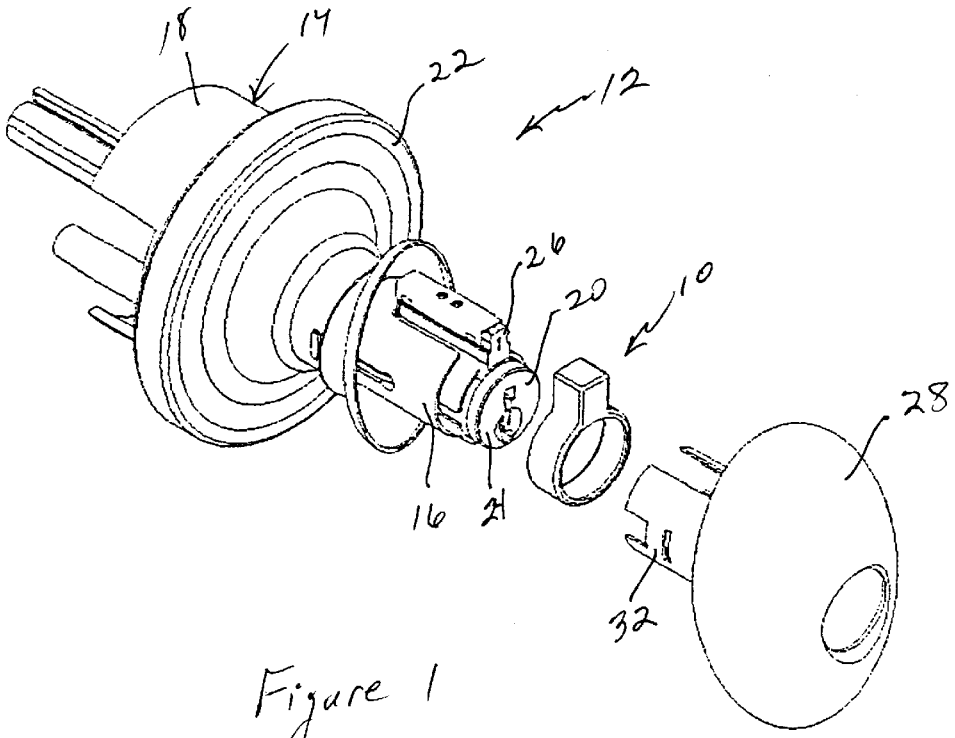
FIG. 1 is an exploded view of a door knob assembly incorporating a lock cylinder retainer according to the present invention.
Figure 2:
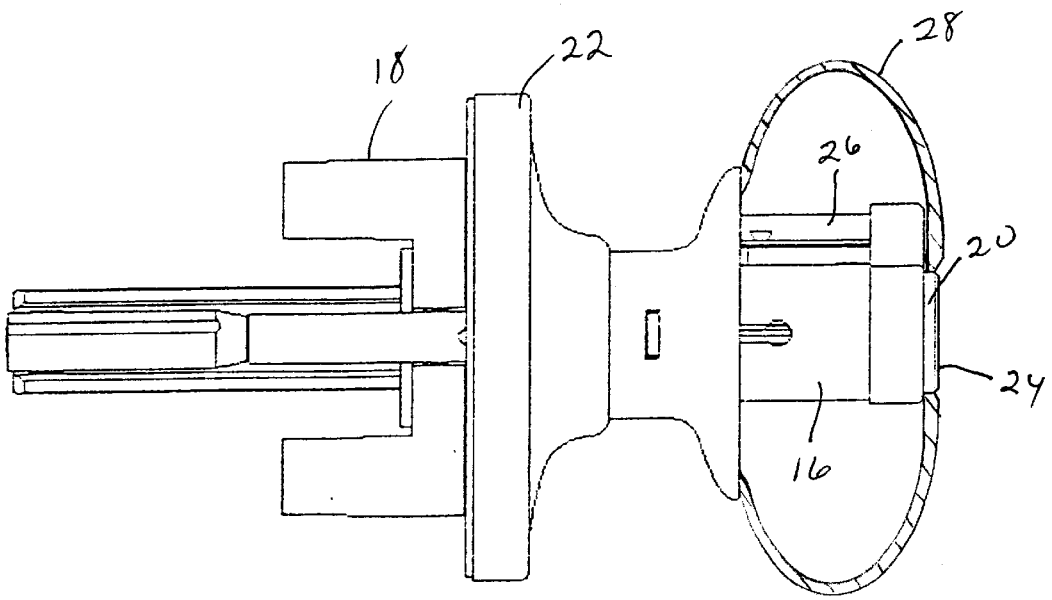
FIG. 2 is a side view of a lock cylinder retainer installed on a lock cylinder, with the door knob shown in section.
Figure 3:
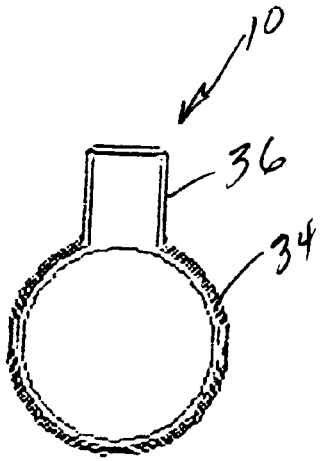
FIGS. 3–7 illustrate various views of a lock cylinder retainer.
Figure 4:
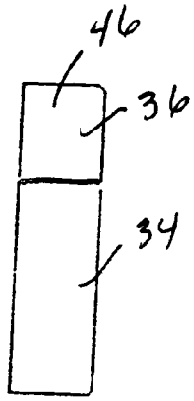
Figure 5:
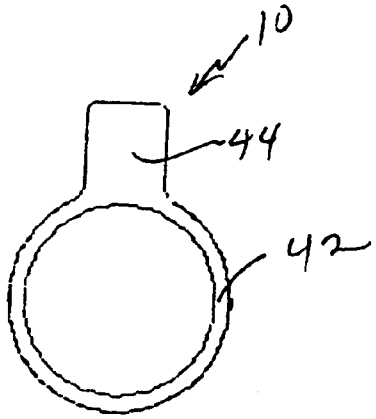
Figure 6:
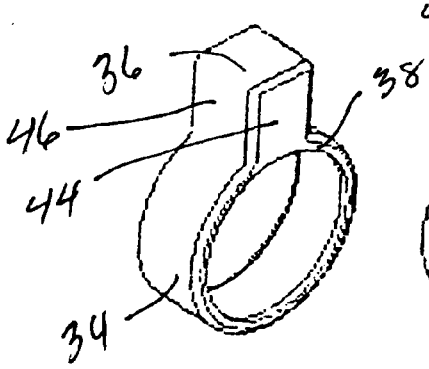
Figure 7:
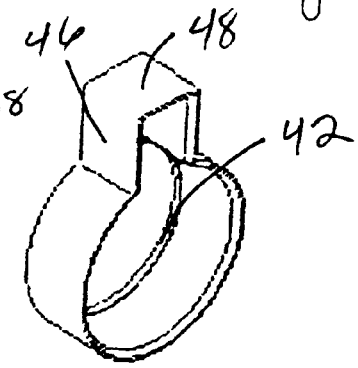

A lock cylinder retainer 10 according to the present invention is illustrated in FIG. 1 in position relative to an otherwise conventional knob assembly 12. The knob assembly 12 includes a sleeve subassembly 14 or chassis having a sleeve 16 extending from a shield 18. A rose cover 22 lies over the shield 18 to provide a more pleasing appearance. A conventional lock cylinder 20 is disposed in the sleeve 16. The lock cylinder 20 includes a cylinder core 24 and a pin housing 26, with the pin housing 26 cooperating with the core 24 to house a plurality of locking pins (not shown). The core 24 extends axially beyond the pin housing 26, and is received in a lock cylinder access opening in a front surface of the knob as seen in FIG. 2. A knob 28 includes a sleeve 32 that slides over the sleeve 16 to engage the sleeve subassembly 14.

The lock cylinder retainer 10 includes an annular portion 34 and a rectangular portion 36 extending radially from the annular portion 34. The annular portion 34, which is sized and configured to align with, and fit over, the cylinder core 24, includes a front edge 38 and a flange 42 extending inwardly from the front edge 38. The rectangular portion 36 is sized and configured to align with, and fit over a portion of, the pin housing 26. The rectangular portion 36 includes a front wall 44, a pair of parallel sidewalls 46 and a top wall 48, all of which cooperate to enclose the front portion of the pin housing 26 and prevent the retainer 10 from rotating about the cylinder core 24.

As illustrated in FIG. 2, the retainer 10 is disposed between the lock cylinder 20 and the knob 28 and fills any gap between the pin housing 26 and the inside surface of the knob 28. Preferably, the retainer 10 is made from a plastic material that will deform as necessary to provide a snug fit.

While the present invention has been described with particular reference to a preferred embodiment of a lockset mechanism, one skilled in the art will recognize that the present invention may be readily adapted to embodiments other than those described with reference to the preferred embodiments. Furthermore, those skilled in the art will readily recognize from the foregoing discussion and accompanying drawings and claims, that changes, modifications and variations can be made in the present invention without departing from the spirit and scope thereof as defined in the following claims.

What is claimed is:

1. A doorknob assembly comprising:

a chassis having a sleeve;

a knob coupled to the sleeve and having a front surface with a lock cylinder access opening;

a lock cylinder disposed in the sleeve; and a cylinder retainer disposed between the lock cylinder and the front surface of the knob, the retainer including an annular portion and a rectangular portion extending from the annular portion transversely to a longitudinal axis of the lock cylinder, the annular portion being configured to engage the lock cylinder and the rectangular portion being configured to receive therein a pin housing associated with the lock cylinder, the retainer being disposed substantially within the doorknob.

2. The doorknob assembly of claim 1 wherein the annular portion includes a front edge and a flange extending radially inwardly from the front edge.

3. The doorknob assembly of claim 1 wherein the rectangular portion includes a front surface, a pair of parallel side surfaces and a top surface, the front surface being disposed between the pin housing and an inside surface of the door knob.

* * * * *